US011140934B2

(12) United States Patent
Jensen

(10) Patent No.: US 11,140,934 B2
(45) Date of Patent: Oct. 12, 2021

(54) HAIR ADDITION

(71) Applicant: Psykhe Hair Extensions, Inc., Kaysville, UT (US)

(72) Inventor: Jennae Jensen, Kaysville, UT (US)

(73) Assignee: Psykhe Hair Extensions, Inc, Kaysville, UT (US)

( * ) Notice: Subject to any disclaimer, the term of this patent is extended or adjusted under 35 U.S.C. 154(b) by 698 days.

(21) Appl. No.: 15/986,014

(22) Filed: May 22, 2018

(65) Prior Publication Data

US 2018/0343946 A1 Dec. 6, 2018

Related U.S. Application Data

(60) Provisional application No. 62/512,543, filed on May 30, 2017.

(51) Int. Cl.

| | |
|---|---|
| ***A41G 5/00*** | (2006.01) |
| ***A45D 8/24*** | (2006.01) |
| ***A45D 8/00*** | (2006.01) |
| ***A45D 8/36*** | (2006.01) |
| ***A45D 8/20*** | (2006.01) |

(52) U.S. Cl.

CPC ..... *A41G 5/0053* (2013.01); *A41G 5/002* (2013.01); *A41G 5/0046* (2013.01); *A45D 8/00* (2013.01); *A45D 8/20* (2013.01); *A45D 8/24* (2013.01); *A45D 8/36* (2013.01)

(58) Field of Classification Search

CPC .... A41G 5/004; A41G 5/0053; A41G 3/0008; A41G 3/005; A41G 3/0058; A41G 3/0041; A41G 5/006; A41G 8/36; A41G 5/0046; A41G 5/002; A41G 3/0016; A41G 5/0013; A41G 5/0026

USPC ..... 132/53

See application file for complete search history.

(56) References Cited

U.S. PATENT DOCUMENTS

| | | | | |
|---|---|---|---|---|
| 1,545,881 A * | 7/1925 | Cohen | A41G 3/0041 132/54 |
| 4,600,029 A | 7/1986 | Ueberschaar | |
| 5,135,011 A * | 8/1992 | Motoori | A41G 3/0041 132/54 |
| 5,551,452 A * | 9/1996 | Barlow | A41G 5/00 132/201 |
| 5,979,462 A | 11/1999 | Jones | |

(Continued)

FOREIGN PATENT DOCUMENTS

DE 202015000138 * 3/2015

*Primary Examiner* — Yogesh P Patel
*Assistant Examiner* — Jennifer Gill
(74) *Attorney, Agent, or Firm* — Loyal Intellectual Property Law, PLLC; Travis Banta

(57) ABSTRACT

Disclosed herein is a hair addition for adding volume, texture, and density to the side of a user's head and hairline. The hair addition, in one embodiment, includes two or more wires to which wefts of hair are attached. The hair addition further includes one or more double layer portions of hair and one or more single layer portions of hair. In another embodiment, the hair addition includes one or more wires to which wefts of hair are attached. At least some of the wefts of hair are slidable along the one or more wires. The hair addition further includes elastic cordage connecting to the one or more wires one each end of the one or more wires and an intermediate connector connecting the wires and the elastic cordage.

18 Claims, 11 Drawing Sheets

(56) References Cited

U.S. PATENT DOCUMENTS

| | | | | |
|---|---|---|---|---|
| 8,316,864 | B2 * | 11/2012 | Freelove | A41G 5/0053 132/201 |
| 8,739,803 | B2 * | 6/2014 | Freelove | A41G 5/0053 132/53 |
| 8,859,926 | B2 * | 10/2014 | Freelove | A41G 5/0046 218/53 |
| 9,113,669 | B1 * | 8/2015 | Kleinman | A41G 5/0046 |
| 2005/0268928 | A1 * | 12/2005 | Lane | A41G 3/00 132/53 |
| 2008/0072920 | A1 * | 3/2008 | Ladue | A41G 5/004 132/201 |
| 2010/0065078 | A1 * | 3/2010 | Reece | A41G 5/006 132/54 |
| 2010/0275940 | A1 | 11/2010 | Kallabat et al. | |
| 2010/0313902 | A1 * | 12/2010 | Lane | A41G 5/0073 132/54 |
| 2015/0013710 | A1 * | 1/2015 | Buzaglo | A41G 5/0093 132/201 |
| 2015/0327611 | A1 * | 11/2015 | Kleinman | A41G 5/0073 132/201 |
| 2016/0143381 | A1 * | 5/2016 | Helmers | A41G 5/0073 132/53 |
| 2017/0208885 | A1 * | 7/2017 | Alex | A41G 5/0093 |
| 2018/0206571 | A1 * | 7/2018 | Kim | A41G 5/0053 |

* cited by examiner

HAIR ADDITION

CROSS-REFERENCE TO RELATED APPLICATION

This application claims the benefit of U.S. Provisional Application No. 62/512,543, filed May 30, 2017, which is incorporated herein by reference in its entirety, including but not limited to those portions that specifically appear hereinafter, the incorporation by reference being made with the following exception: In the event that any portion of the above-referenced application is inconsistent with this application, this application supercedes said above-referenced application.

BACKGROUND

1. Technical Field

This disclosure relates generally to a wearable hair addition. In one embodiment, a plurality of wefts of hair may be secured to one or more wires to supplement existing hair on a wearer's head. In one embodiment, the plurality of wefts of hair may be separated so as to provide a part in the wearable hair addition.

2. Description of the Related Art

A person's hair has, since the earliest records of mankind's existence, been integral to the human experience. Some representations of human beings carved in antiquity include hair on the representations. Some of mankind's oldest stories include descriptions of hair on a story character's head. One example of such a story is Sampson and Delilah in which Sampson derived virtually unlimited power against his enemies so long as he did not cut his hair. Some cultures, such as the ancient Egyptians, have passed down writings concerning wig making, shampoo concoctions, and prescriptions for reversing hair loss.

The fact that these ancient writings contain so much detail on hair illustrates the importance that hair has traditionally held in the lives of people. Thus, when certain people experience hair loss for various reasons, the emotional toll of losing hair can be devastating. For example, as people age, their hair tends to stop growing in some areas of their head or, at least, lose some thickness (e.g., density of hair follicles per unit area) on some areas of the person's head. Certain medications can also cause people to lose their hair during treatment. Temporary conditions, such as pregnancy, may also cause hair to change in growth patterns and thin or fall out. Some people who struggle with stress or anxiety issues may pull their hair from their head as a nervous tick. Parents, mothers especially, may experience hair loss and hair thinning during child rearing.

When hair has been such a traditionally important aspect of the human experience, these conditions can cause a person to suffer from self-consciousness, anxiety, depression, and other discomfort caused by a change in that person's appearance due to changes in their hair growth. As hair is a significant aspect of a person's general appearance, many people with hair conditions or irregularities struggle to present a public perception that they are comfortable with.

Some historical solutions to hair conditions or irregularities include the use of wigs which covered a person's head with hair. Wigs were originally made of natural materials, such as human or animal hair, and tied in a pattern to simulate the growth of actual hair on a person's head. More recently, human and animal hair have been replaced, in some situations, by synthetic materials that are reasonably similar in appearance, texture, and feel to natural hair. However, wigs tend to increase a wearer's perceived body temperature and can be itchy and uncomfortable to wear.

For others who experience hair thinning, or who have perfectly healthy hair growth but desire a fuller hair appearance (e.g., an appearance of a higher number of hair follicles per unit area), hair extensions have been developed. Hair extensions allow a person to add length or volume to existing hair in a variety of ways. For example, hair may be attached to one or more hair clips and may be effectively sewn into a track for person's scalp. Other hair extensions may be woven into existing hair. These conventional hair extensions, however, have a number of problems. First, conventional hair extensions can be quite painful to have installed. Second, existing hair in a particular area of the head may be too thin to allow for a woven connection to a hair extension. Third, hair tends to grow over time, which causes hair extensions to grow out from the person's head (e.g., when the hair extensions are installed, they are woven into hair as close to the scalp as possible but, when the hair grows, the woven extensions are separated from the scalp by the new growth). Thus, the hair extensions must be replaced at regular intervals to maintain a natural looking appearance.

One further problem with conventional hair extensions is that hair extensions cannot typically be added on the sides of the head because either there is insufficient hair to attach the hair extensions, or if the hair extensions can be attached, the person lacks sufficient hair to cover the extensions with natural hair. If the hair extensions become visible, the wearer's appearance, at least the wearer's perceived appearance, may be compromised, which negates much of the reason to install hair extensions.

Accordingly, a need exists for a hair addition that may be applied to the sides and front of a person's head without weaving or sewing. Further, a need exists for a hair addition that is virtually indistinguishable on a person's head. A need also exists for a hair addition that can be parted along a wearer's natural part. Finally, a need exists for a hair addition that can be seamlessly and comfortably installed on a wearer's head.

SUMMARY

Disclosed herein is a hair addition. In one embodiment, the hair addition includes two or more wires to which wefts of hair are attached. The hair addition further includes one or more double layer portions of hair and one or more single layer portions of hair.

In another embodiment, the hair addition includes one or more wires to which wefts of hair are attached. At least some of the wefts of hair are slidable along the one or more wires. The hair addition further includes elastic cordage connecting to the one or more wires one each end of the one or more wires and an intermediate connector connecting the wires and the elastic cordage.

BRIEF DESCRIPTION OF THE DRAWINGS

The accompanying drawings illustrate one or more embodiments of a hair addition.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1A:
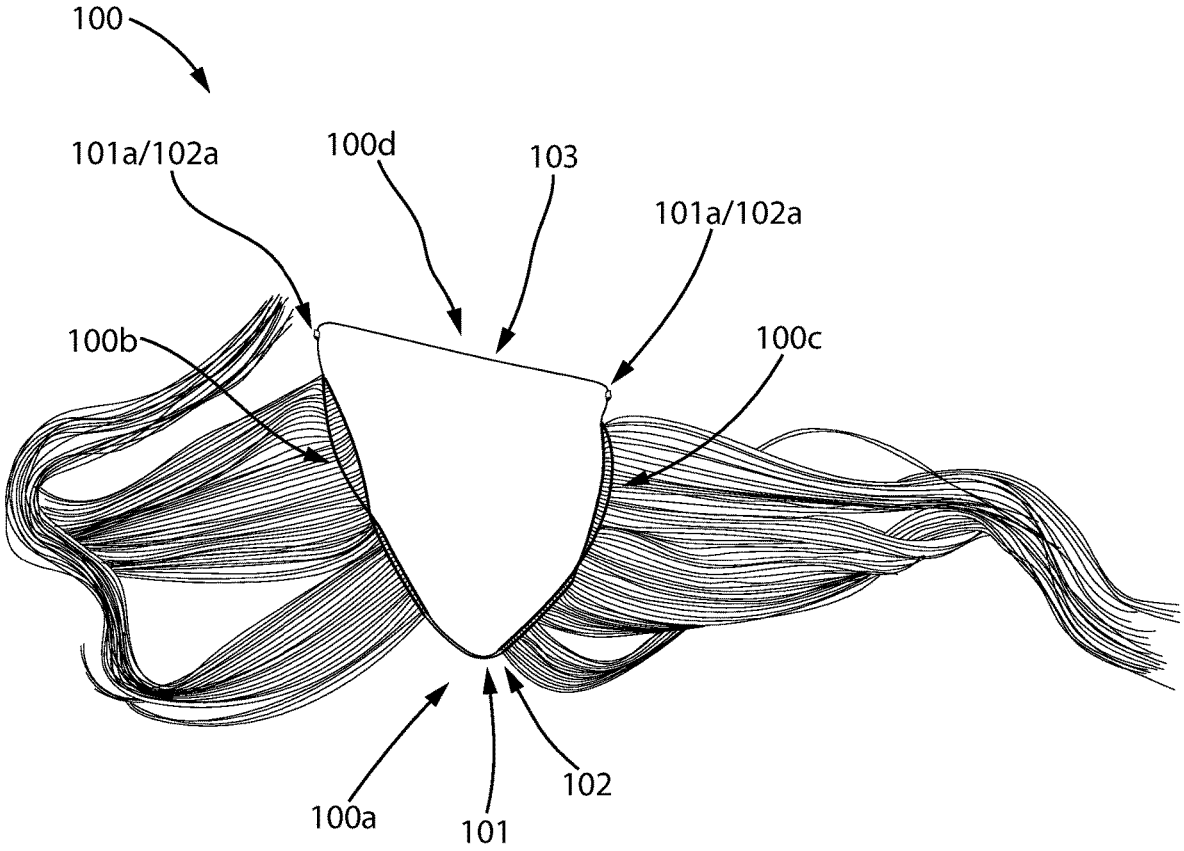
FIG. 1A illustrates a hair addition apparatus using two wires.

FIG. 1A illustrates a hair addition apparatus 100 using two wires, wire 101 and wire 102. As shown in FIG. 1A, wire 101 and wire 102 are arranged in parallel and have a plurality of wefts of hair attached to wire 101 and wire 102. Typically, wefts of hair may be attached using a "dutch weft" technique, although other wefting techniques known in the art may also be suitable for this particular implementation. Specifically, each weft of hair in the plurality of wefts of hair may be tied or woven to only wire 101, only wire 102 or to both wires 101 and 102, depending on specific implementations of hair addition 100. It is possible that hair addition 100 may include more wires than wire 101 and wire 102, as will be discussed below, however, in the implementation of FIG. 1A, hair addition 101 includes wire 101 and wire 102.

Hair addition 100 may be provided with an orientation shown in FIG. 1A. For example, hair addition 100 may include a front portion 100*a*, a first side portion 100*b*, a second side portion 100*b*, and a rear portion 100*d* which may correspond to portions of a person's head. For example, front portion 100*a*, when installed, may be disposed above a person's forehead, as will be discussed below. First side portion 100*b* may be disposed on a left side of a person's forehead. Second side portion 100*c* may be disposed on a right side of a person's forehead. Rear portion 100*d* may be disposed on a rear portion of a person's head.

In one embodiment, after the plurality of wefts have been installed on wire 101 and wire 102, wire 101 and wire 102 may be terminated by securing them together or to intermediate connectors 101*a*/102*a* positioned on either side of hair addition 100. Intermediate connectors 101*a*/102*a* may be provide a connection, such as a loop, through which wire 101 and wire 102 can be attached on opposite ends of wire 101 and wire 102. Intermediate connectors 101*a*/102*a* may further provide a connection point to elastic cordage 103 on both ends of elastic cordage 103. Intermediate connectors 101*a*/102*a* may be transparent or may be a color that matches a user's hair or may be a color that matches the user's scalp to reduce visibility of intermediate connectors 101*a*/102*a*.

Elastic cordage 103 may be implemented using a stretchable length of cordage. For example, elastic cordage 103 may be implemented using cordage that stretches by elastic tension to tighten hair addition 100 around a person's head, as will be discussed below. Elastic cordage 103 may further be implemented as transparent elastic cordage. It is desirable that elastic cordage 103 be as invisible as possible to other users. For example, types of fluorocarbon plastics may be suitable for use in elastic cordage 103 since fluorocarbon plastics provide a virtually transparent and stretchable plastic in certain implementations. Typically, elastic cordage 103 may act as a rear portion 100*d* of hair addition 100 and may be worn such that elastic cordage 103 tightens hair addition 100 around a back portion of a user's head. Elastic cordage 103 may provide a constricting force which retains hair addition 100 on the user's head in a desired position.

Figure 1B:
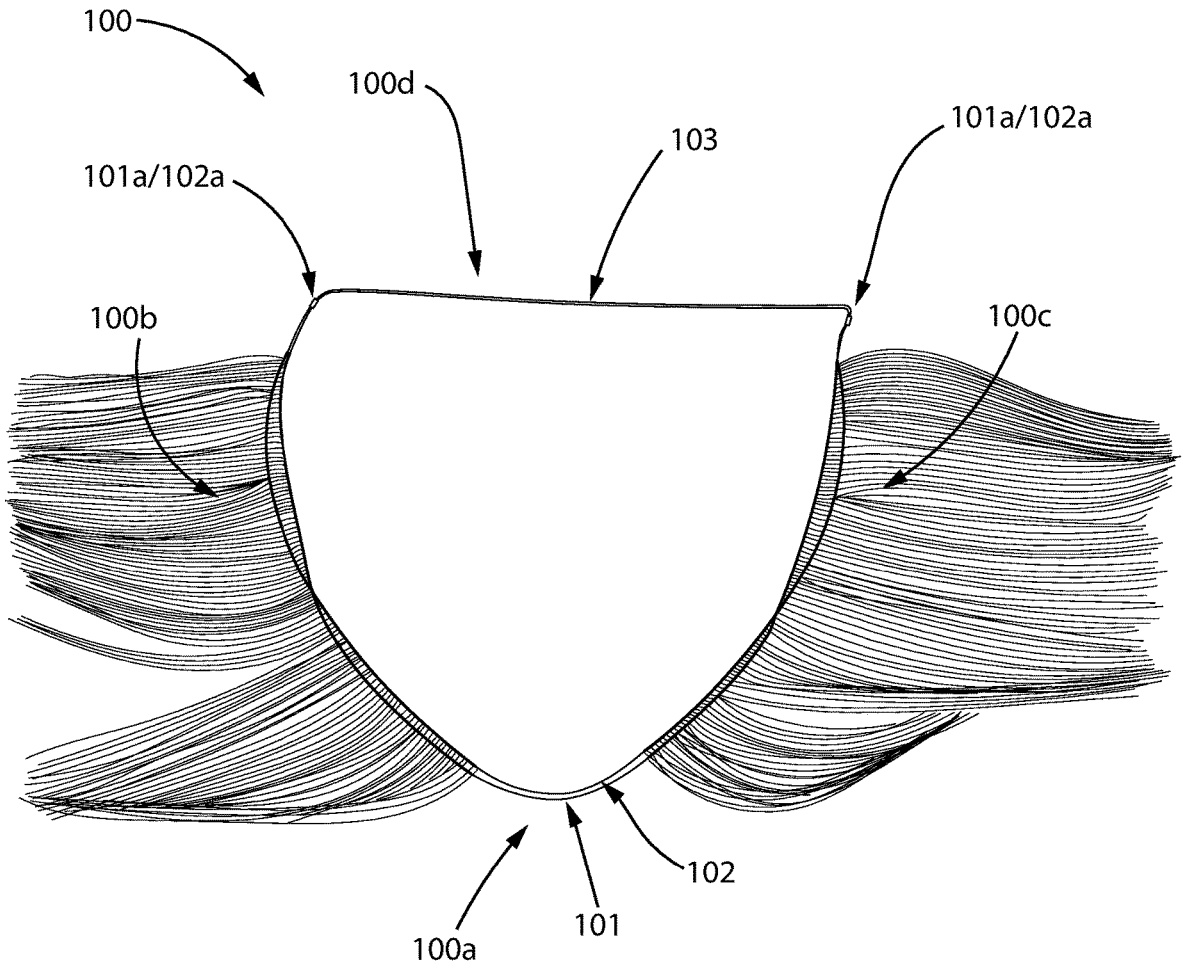
FIG. 1B illustrates a hair addition apparatus using four wires.

FIG. 1B illustrates a hair addition apparatus 100 using four wires, a first pair of wires 101 and a second pair of wires 102. As shown in FIG. 1B, first pair of wires 101 and second pair of wires 102 are arranged in parallel and have a plurality of wefts of hair attached to first pair of wires 101 and second pair of wire 102. That is to say that each weft of hair in the plurality of wefts of hair may be tied or woven to only first pair of wires 101, to only second pair of wires 102 or to both first and second pairs of wires 101 and 102, depending on specific implementations of hair addition 100. It is possible that hair addition 100 may include fewer or more wires than first pair of wires 101 and second pair of wires 102, as will be discussed below, however, in the implementation of FIG. 1*b*, hair addition 101 includes first pair of wires 101 and second pair of wires 102. This implementation, using pairs of wires, facilitates separation of first pair of wires 101 and second pair of wires 102 to provide additional layers of hair in certain portions of hair addition 100, which will be discussed below. Further, implementing a first pair of wires 101 and a second pair of wires 102 provides increased strength and support to the plurality of wefts of hair disposed along first pair of wires 101 and second pair of wires 102.

FIG. 1B further illustrates that hair addition 100 may be provided with an orientation shown in FIG. 1B. For example, hair addition 100 may include a front portion 100*a*, a first side portion 100*b*, a second side portion 100*b*, and a rear portion 100*d* which may correspond to portions of a person's head. For example, front portion 100*a*, when installed, may be disposed above a person's forehead, as will be discussed below. First side portion 100*b* may be disposed on a left side of a person's forehead. Second side portion 100*c* may be disposed on a right side of a person's forehead. Rear portion 100*d* may be disposed on a rear portion of a person's head.

In one embodiment, after the plurality of wefts have been installed on first pair of wires 101 and second pair of wires 102, first pair of wires 101 and second pair of wires 102 may be terminated by securing them together or to intermediate connectors 101*a*/102*a* positioned on either side of hair addition 100. Intermediate connectors 101*a*/102*a* may provide a connection, such as a loop, through which first pair of wires 101 and second pair of wires 102 can be attached on opposite ends of first pair of wires 101 and second pair of wires 102. Intermediate connectors 101*a*/102*a* may further provide a connection point to elastic cordage 103 on both ends of elastic cordage 103. Intermediate connectors 101*a*/102*a* may be transparent or may be a color that matches a user's hair or may be a color that matches the user's scalp to reduce visibility of intermediate connectors 101*a*/102*a*.

As before, elastic cordage 103 may be implemented using a stretchable length of cordage. For example, elastic cordage 103 may be implemented using cordage that stretches by elastic tension to tighten hair addition 100 around a person's head, as will be discussed below. Elastic cordage 103 may further be implemented as transparent elastic cordage. It is desirable that elastic cordage 103 be as invisible as possible to other users. For example, types of fluorocarbon plastics may be suitable for use in elastic cordage 103 since fluorocarbon plastics provide a virtually transparent and stretchable plastic in certain implementations. Typically, elastic cordage 103 may act as a rear portion 100*d* of hair addition 100 and may be worn such that elastic cordage 103 tightens hair addition 100 around a back portion of a user's head. Elastic cordage 103 may provide a constricting force which retains hair addition 100 on the user's head in a desired position.

Figure 1C:
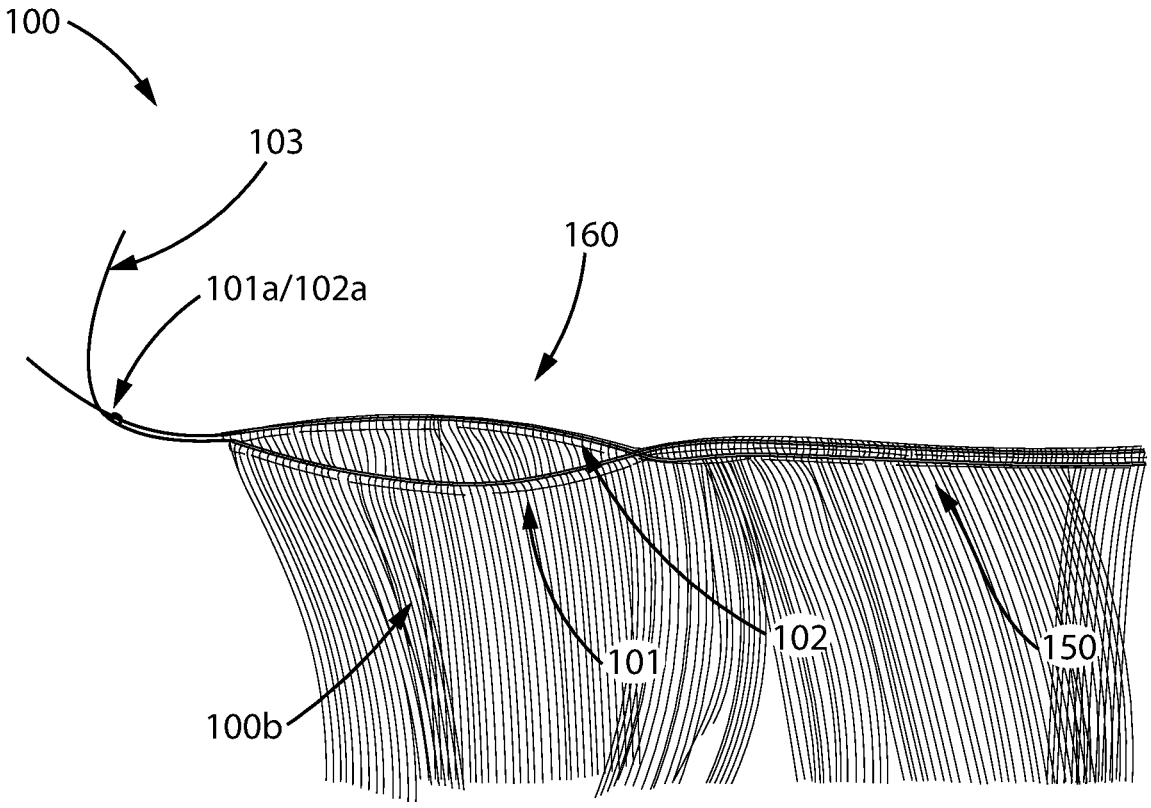
FIG. 1C illustrates a double layer portion of the hair addition apparatus shown in FIG. 1A.

FIG. 1C illustrates a double layer portion of the hair addition apparatus shown in FIG. 1A. As shown in FIG. 1C, wires 101 and wires 102 are implemented as single wires. However, as shown in FIG. 1C, hair addition 100 is separated into a single layer section 150 and a double layer section 160. Further, only a section of hair addition 100 is shown in FIG. 1C, which includes a first side 100*b*, which corresponds to the orientation discussed above. Hair addition 100 may further terminate wires 101*a* and wires 102*a* at intermediate connection 101*a*/102*a*, as previously discussed. Elastic cordage 103 may also be attached to intermediate connection 101*a*/102*a*, as previously discussed.

As shown in FIG. 1C, single layer section 150 includes a plurality of hair wefts which are secured around both wire 101 and wire 102 simultaneously. In other words, the various wefts of hair attach wire 101 and wire 102 together in the single layer section 150 of hair addition 100. However, at one point, wefts of hair are tied individually to wire 101 and other wefts of hair are tied individually to wire 102 to begin a double layer section 160 of hair addition 100. In this manner, hair may be attached to wire 101 and wire 102 at an increased density per linear unit of wire 101 and wire 102. For example, double layer section 160 of hair addition 100 effectively increases the density of hair in double layer section 160 by two times over the density of hair in single layer section 150.

This implementation is advantageous for a plurality of reasons. First, increasing hair density in a particular area is desirable to supplement natural hair that has thinned in density or add hair to a particular area that has no hair. Second, hair addition 100 may be strategically placed on the head of a user such that double layer section 160 supplements or replaces hair on the sides or front of a user's head. Conventional hair extensions have failed to adequately and painlessly supplement hair on the side of the head and hair that lines the forehead, typically referred to as a "hair line" (typically for men) and "bangs" (typically for women). For example, single layer section 150 may supplement hair in the bangs while double layer section 160 may supplement hair specifically between the user's forehead and the user's ear, for example. While double layer section 150 may extend to be as long as is desirable, for example, double layer section 150 may extend past a user's ear, it is typically desirable that double layer section 150 provide hair between a user's bangs and a user's ear.

Figure 1D:
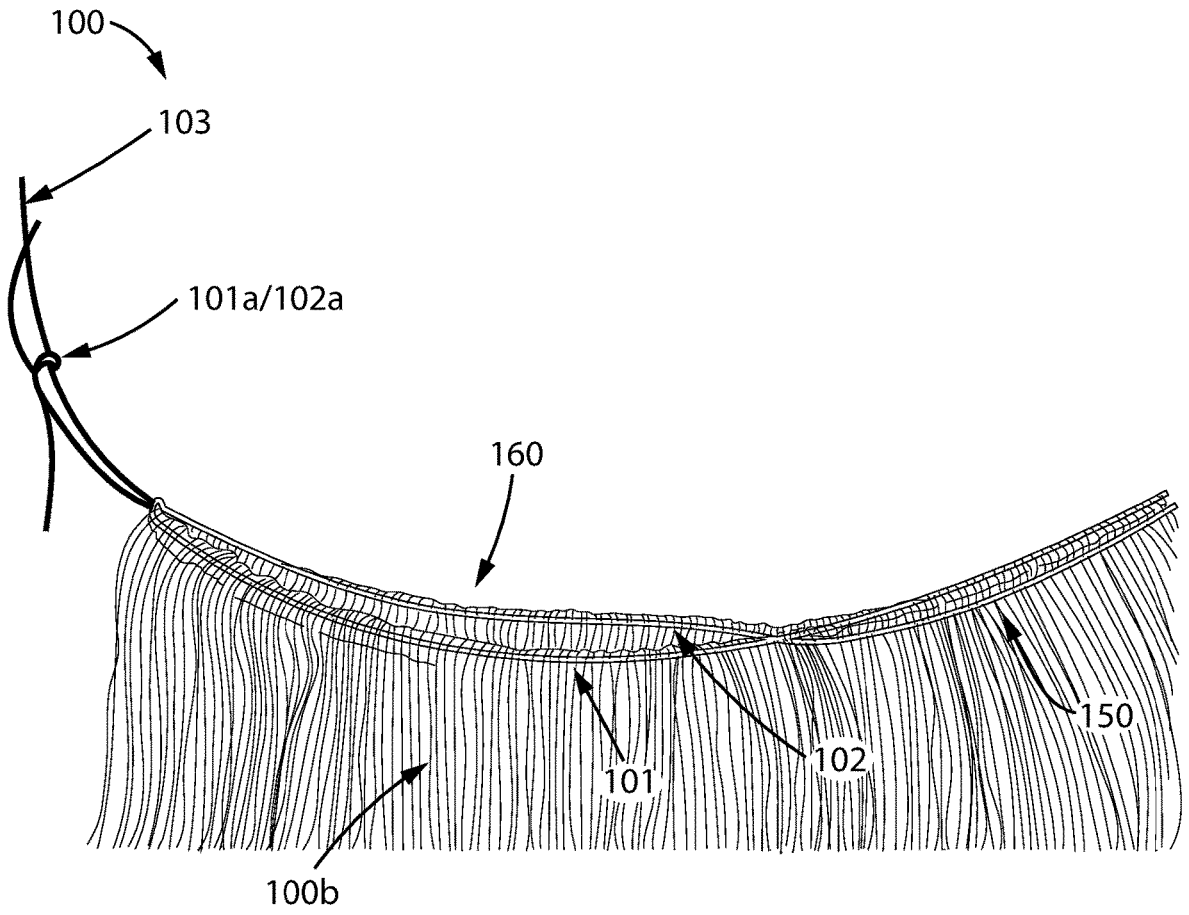
FIG. 1D illustrates a double layer portion of the hair addition apparatus shown in FIG. 1B.

FIG. 1D illustrates a double layer portion of the hair addition apparatus shown in FIG. 1B. As shown in FIG. 1D, first pair of wires 101 and second pair of wires 102 are implemented as two separate pairs of wires. As shown in FIG. 1D, hair addition 100 is separated into a single layer section 150 and a double layer section 160. Further, only a section of hair addition 100 is shown in FIG. 1D, which includes a first side 100*b*, which corresponds to the orientation discussed above. Hair addition 100 may further terminate wires 101*a* and wires 102*a* at intermediate connection 101*a*/102*a*, as previously discussed. Elastic cordage 103 may also be attached to intermediate connection 101*a*/102*a*, as previously discussed.

As shown in FIG. 1D, single layer section 150 includes a plurality of hair wefts which are secured around both first pair of wires 101 and second pair of wires 102 simultaneously. In other words, the various wefts of hair attach first pair of wires 101 and second pair of wires 102 together in the single layer section 150 of hair addition 100. However, at one point, wefts of hair are tied individually to first pair of wires 101 and other wefts of hair are tied individually to second pair of wires 102 to begin a double layer section 160 of hair addition 100. In this manner, hair may be attached to first pair of wires 101 and second pair of wires 102 at an increased density per linear unit of first pair of wires 101 and second pair of wires 102. For example, double layer section 160 of hair addition 100 effectively increases the density of hair in double layer section 160 by two times over the density of hair in single layer section 150.

In the implementation shown in FIG. 1D, it is to be noted that two pairs of wires, such as first pair of wires 101 and second pair of wires 102 are attached by the various wefts of hair to single layer section 150 of hair addition 100. However, at a particular point, first pair of wires 101 and second pair of wires 102 diverge to provide double layer section 160 in which individual wefts of hair are tied only to first pair of wires 101 and only to second pair of wires 102 to effectively double the hair density of double layer section 160 as compared to single layer section 150. The implementation of pairs of wires as first pair of wires 101 and second pair of wires 102 provides additional rigidity, strength, and stability to hair addition 100. In some embodiments, however, using pairs of wires, such as first pair of wires 101 and second pair of wires 102 increases the thickness of wires used in hair addition 100, and, therefore, may result in wires and the wefting along the wires being more visible to others. Thus, depending on a specific person or a specific implementation, it may be more desirable to use a single wire, as discussed above, if a person lacks substantial hair on the top and sides of their head. However, if a person merely desires to supplement the total amount of hair on the top and sides of their head, using a hair addition that implements first pair of wires 101 and second pair of wires 102 because sufficient hair exists on the user's head to hide first pair of wires 101 and second pair of wires 102.

This implementation is also advantageous for reasons similar to those discussed above. First, increasing hair density in a particular area is desirable to supplement natural hair that has thinned in density or add hair to a particular area that has no hair. Second, hair addition 100 may be strategically placed on the head of a user such that double layer section 160 supplements or replaces hair on the sides or front of a user's head. Conventional hair extensions have failed to adequately and painlessly supplement hair on the side of the head and hair that lines the forehead, typically referred to as a "hair line" (typically for men) and "bangs" (typically for women). For example, single layer section 150 may supplement hair in the bangs while double layer section 160 may supplement hair specifically between the user's forehead and the user's ear, for example. While double layer section 150 may extend to be as long as is desirable, for example, double layer section 150 may extend past a user's ear, it is typically desirable that double layer section 150 provide hair between a user's bangs and a user's ear.

Finally, it is to be noted that additional pairs of wires could be added to hair addition 100 to provide for a single layer portion, a double layer portion, and a triple layer portion. This concept may be effectively extended to provide any number of layers of hair by adding an additional wire or pair of wires. For example, the use of three wires in hair addition 100 may allow for a triple layer section of hair to be developed for hair addition 100. Similarly, it is possible that six wires, three pairs of wires, may allow for a triple layer section of hair to be developed for hair addition 100. This concept can be scaled such that any number of layers of hair may be provided to suit a particular implementation.

Figure 2A:
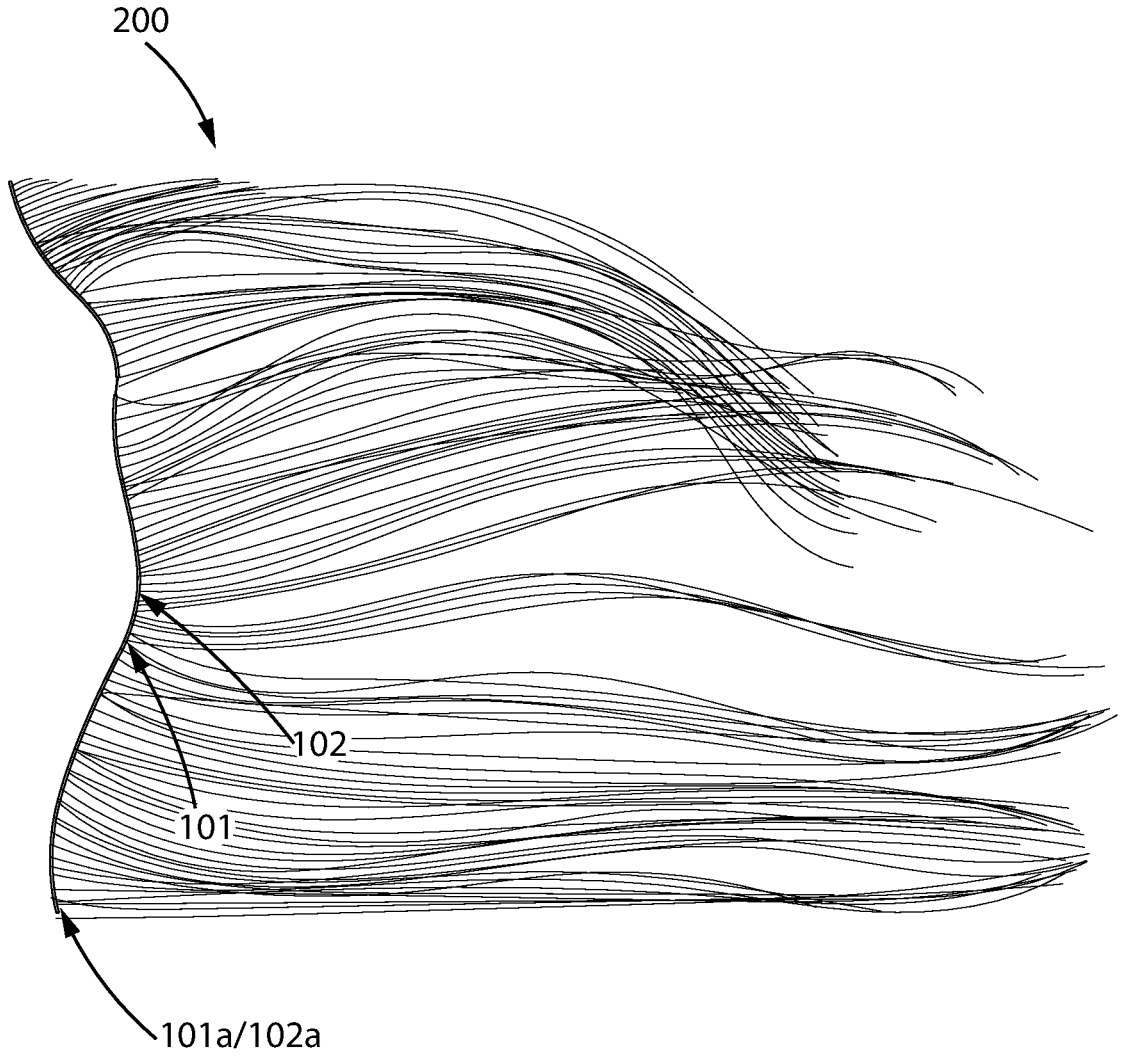
FIG. 2A illustrates a hair addition apparatus having only a single layer portion.

FIG. 2A illustrates a hair addition apparatus 200 having only a single layer portion. As shown in FIG. 2A, hair addition 200 includes wires 101 and wires 102 in a manner similar to that discussed above. For the purposes of FIG. 2A, wires 101 and wires 102 may be implemented as single wires or pairs of wires. Hair addition 200 further includes intermediate connectors 101*a*/102*a* which terminate wires 101 and wires 102 as previously discussed.

As previously discussed, each weft of hair may be tied to wires 101 and wires 102 using a dutch wefting technique. Other techniques are possible, however, the dutch weft is preferred. One advantage of the dutch weft is that when strands of hair are wefted to wires 101 and wires 102, the dutch weft secures the strands of hair to wires 101 and wires 102 with a robust knot. However, the knot used in the dutch weft is not so tight as to maintain each weft of hair in a particular location along the length of wire 101 and wire 102. Accordingly, each weft of hair along wire 101 and wire 102 may slide along the length of wire 101 and wire 102 using a dutch weft. Further, intermediate connectors 101*a*/102*a* may also retain the wefts of hair on wire 101 and wire 102 in a manner that ensure the wefts of hair cannot fall off wire 101 and wire 102.

Figure 2B:
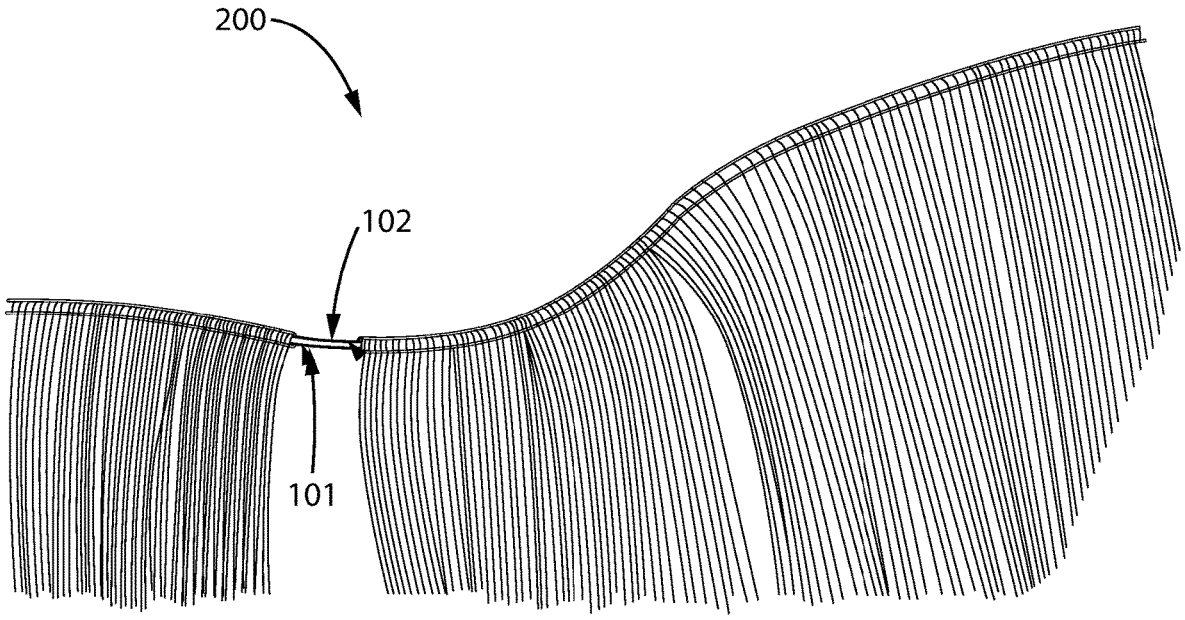
FIG. 2B illustrates a hair addition apparatus having only a single layer portion and a part.

FIG. 2B illustrates a hair addition 200 apparatus having only a single layer portion and a part. As shown in FIG. 2B, wefts of hair on wire 101 and wire 102 have been slid apart so as to create a hair part in hair addition 200. Many people have a natural part in their hair that causes one section of hair to fall from their head in one direction on one side of the part and fall in another direction on a second side of the part, as will be discussed in additional detail below. However, for most people, in most circumstances, the part in their hair extends from the person's hair line/bangs to the crown of their head. A part does not usually extend into hair on the back of the person's head.

Accordingly, since a part usually runs through a portion of a person's head where hair addition 200 is intended to be placed, the part can only be properly maintained if the wefts of hair along wire 101 and wire 102 can be moved to maintain the part in the person's hair. In this embodiment, only two small wires could possibly be visible in a person's hair. In practice, unless another observer was specifically looking for the wires and unusually close to the person's head, wires 101 and wire 102 may be virtually undetectable to virtually any other person, especially when a part in the hair wefted on wire 101 and wire 102 is maintained by sliding the wefted hair to maintain the part.

It should also be noted that the more wires or pairs of wires that are added as wire 101 and wire 102, the higher the likelihood that the wires will be visible in the part of a person's hair. Thus, in situations where a wearer of hair addition 100 lacks sufficient hair to disguise additional wires, the user may prefer to use two wires, such as wire 101 and wire 102. However, in situations where a wearer of hair addition 100 has sufficient hair to disguise additional wires, the user may prefer to use pairs of wires or multiple pairs of wires because the wires will be less detectable by observers.

Figure 3:
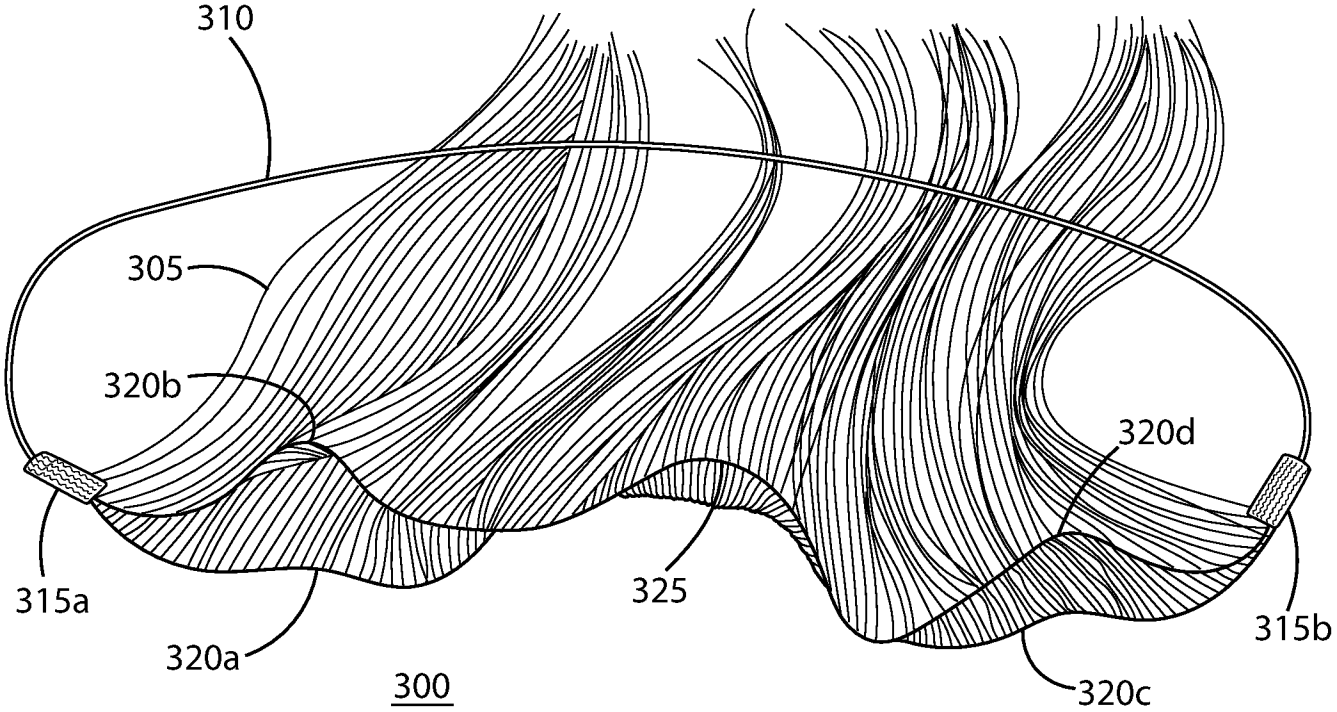
FIG. 3 illustrates a hair addition having a double layer portion and a single layer portion.

FIG. 3 illustrates a hair addition 300 having a two double layer portions 320*a*-320*d* and a single layer portion 325. Hair addition 300 includes hair 305 which is wefted onto two or more wires 320*a*-320*d*. Hair addition includes a length of elastic cordage 310 which is attached to hair addition 300 by intermediate connectors 315*a* and 315*b* on either side of hair addition 300. Elastic cordage 310 may be similar in implementation and description to elastic cordage 103, shown and described above with respect to FIG. 1. Intermediate connectors 315*a* and 315*b* further attach to both ends of two or more wires 320*a*-320*d*. Intermediate connectors 315*a* and 315*b* further terminate wires 320*a*-320*d* such that none of hair 305 which is wefted onto two or more wires 320*a*-320*d* is able to slide off of wires 320*a*-320*d*. Intermediate connectors 315*a* and 315*b* may also be stretchable to facilitate comfort of installing and wearing hair addition 300.

As shown in FIG. 3, the two or more wires 320*a*-320*d* are disposed between intermediate connectors 315*a* and 315*b*. Wires 320*a* and 320*b* are separated after they are joined at intermediate connector 315*a* to create a double layer portion on hair addition 300. Separate wefts of hair 305 are wefted to wire 320*a* and to wire 320*b* to increase a density of hair per length of wire 320*a* and wire 320*b*. Wires 320*a* and 320*b* are joined again at a point where the double layer portion on hair addition 300 is joined into a single layer portion 325 of hair addition 300. At the point where wires 320*a* and 320*b* come together, hair 305 is wefted around both wires 320*a* and 320*b*, joining wires 320*a* and 320*b* together in single layer portion 325 of hair addition 320. After a certain distance, wires 320*a* and 320*b* may be separated again to create a second double layer portion on hair addition 300. At the point where wires 320*a* and 320*b* are separated, hair 305 is wefted separately around each of wires 320*c* and 320*d* (which are the same wires as 320*a* and 320*b* but separately distinguished as wires 320*c* and 320*d* to distinctly identify the wires in the second double layer portion of hair addition 300). In this manner, an increased density of hair may be provided between the point where wires 320*c* and 320*d* are separated from single layer portion 325. Wires 320*c* and 320*d* may be connected to intermediate connector 315*b* and there terminate.

Figure 4:
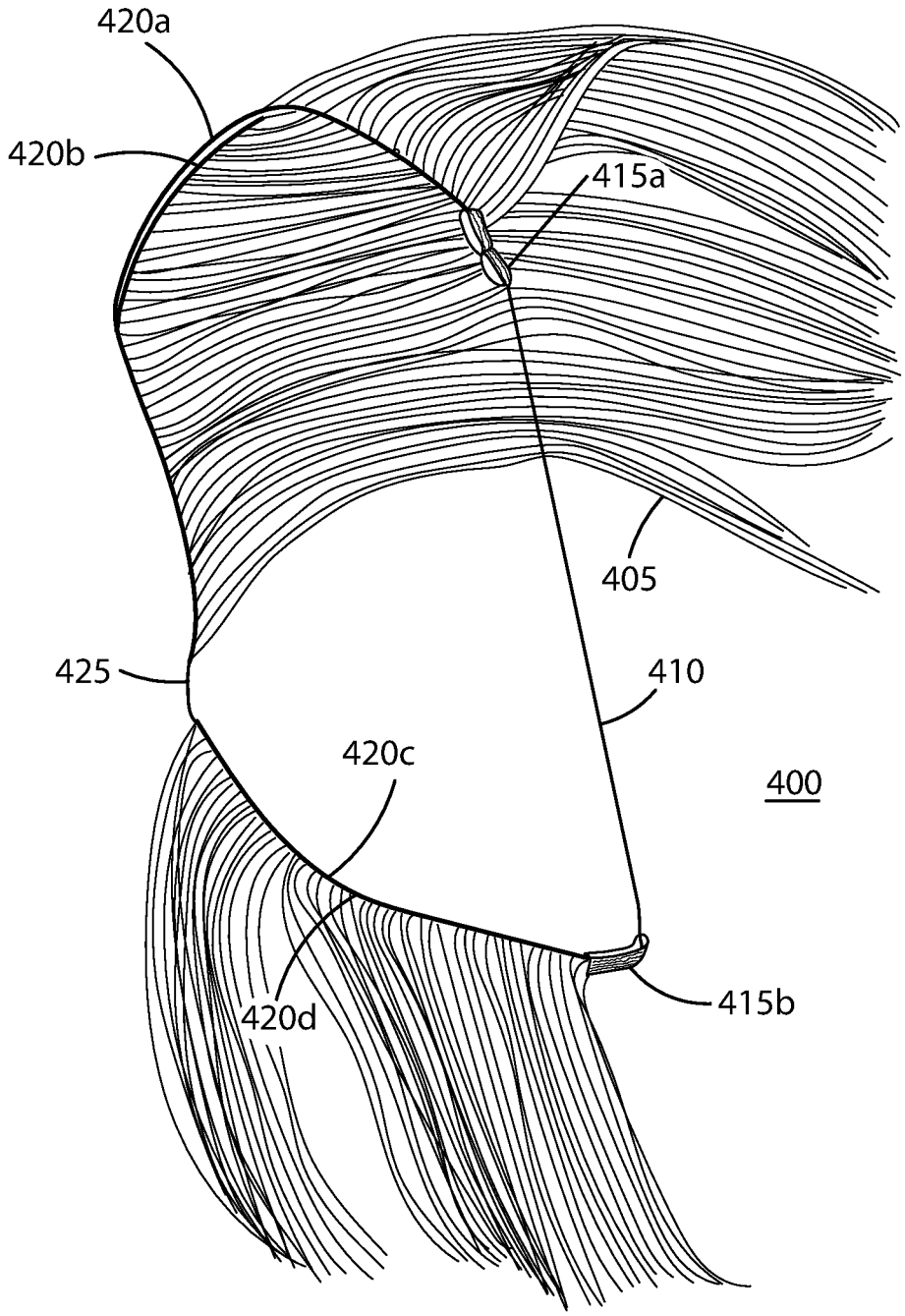
FIG. 4 illustrates a hair addition having a double layer portion and a single layer portion with a part.

FIG. 4 illustrates a hair addition 400 having a double layer portion and a single layer portion with a part 425. Hair addition 400 may be similar in implementation and description to hair addition 300 shown in FIG. 3 and described above. Hair addition 400 includes hair 405 which is wefted onto two or more wires 420*a*-420*d*. Hair addition includes a length of elastic cordage 410 which is attached to hair addition 400 by intermediate connectors 415*a* and 415*b* on either side of hair addition 400. Elastic cordage 410 may be similar in implementation and description to elastic cordage 103, shown and described above with respect to FIG. 1. Intermediate connectors 415*a* and 415*b* further attach to both ends of two or more wires 420*a*-420*d*. Intermediate connectors 415*a* and 415*b* further terminate wires 420*a*-420*d* such that none of hair 405 which is wefted onto two or more wires 420*a*-420*d* is able to slide off of wires 420*a*-420*d*. Intermediate connectors 415*a* and 415*b* may also be stretchable to facilitate comfort of installing and wearing hair addition 400.

As shown in FIG. 4, two distinct double layer portions are created between wire 420*a* and wire 420*b* and between wire 420*c* and wire 420*d*. However, when in position to be installed on the head of a user or worn by a user, the double layer portions are held closely together so as to be virtually indistinguishable.

Nonetheless, the two or more wires 420*a*-420*d* are disposed between intermediate connectors 415*a* and 415*b*. Wires 420*a* and 420*b* are separated after they are joined at intermediate connector 415*a* to create a double layer portion on hair addition 400. Separate wefts of hair 405 are wefted to wire 420*a* and to wire 420*b* to increase a density of hair per length of wire 420*a* and wire 420*b*. Wires 420*a* and 420*b* are joined again at a point where the double layer portion on hair addition 400 is joined into a single layer portion 425 of hair addition 400. At the point where wires 420*a* and 420*b* come together, hair 405 is wefted around both wires 420*a* and 420*b*, joining wires 420*a* and 420*b* together in a single layer portion of hair addition 400. After a certain distance, wires 420*a* and 420*b* may be separated again to create a second double layer portion on hair addition 400. At the point where wires 420*a* and 420*b* are separated, hair 405 is wefted separately around each of wires 420*c* and 420*d* (which are the same wires as 420*a* and 420*b* but separately distinguished as wires 420*c* and 420*d* to distinctly identify the wires in the second double layer portion of hair addition 400). In this manner, an increased density of hair may be provided between the point where wires 420*c* and 420*d* are separated from the single layer portion. Wires 420*c* and 420*d* may be connected to intermediate connector 415*b* and there terminate.

Unique to FIG. 4 is the addition of part 425. As previously discussed, hair 405 may be attached to wires 420*a*-420*d* using a dutch weft technique which allows hair 405 to slide along wires between certain points. For example, hair 405 may slide along a double layer portion or a single layer portion to create parts in hair, as desired. However, part 425 is shown in FIG. 4 as being a part that may correspond with a part that is disposed along the center of the top of a person's head. If a person prefers to part their hair on one side of their head or another, the person can simply slide hair to one side of the single layer portion of hair addition 400 such that the part along the single layer portion of hair addition 400 corresponds with the person's natural hair part. Further, since wires 420*a*-420*d* are relatively small, wires 420*a*-420*d* are virtually invisible to casual observers.

Figure 5:
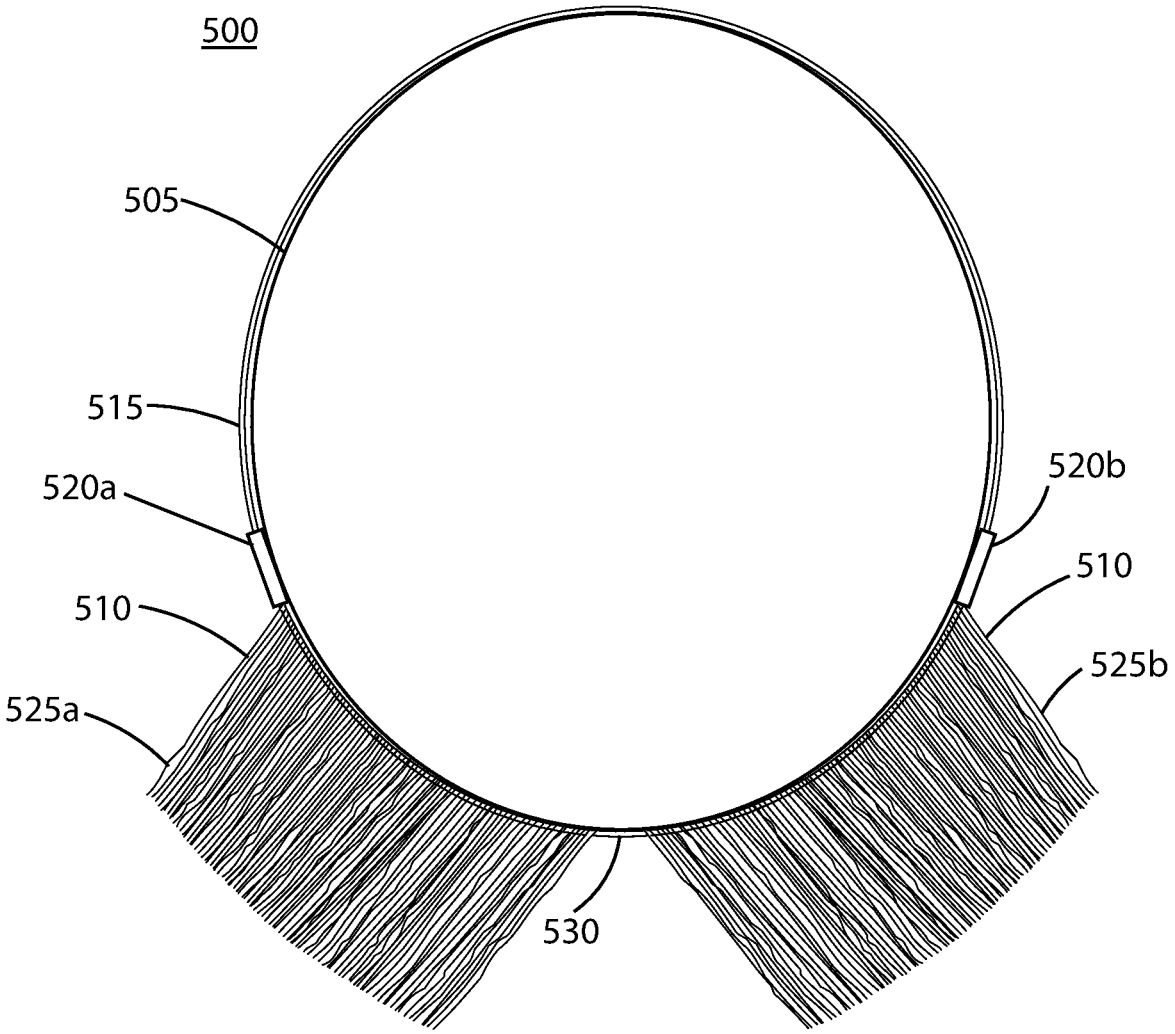
FIG. 5 illustrates a top view of the hair addition illustrated in FIG. 4.

FIG. 5 illustrates a top view of the hair addition 500 illustrated in FIG. 4. Hair addition 500 may be similar in implementation and description to hair addition 300 shown in FIG. 3 and hair addition 400 shown in FIG. 4 and which are described above. FIG. 5 includes a view of a person's head 505 (the person has no hair in FIG. 5) about which hair addition 500 is provided. Hair addition 500 includes hair 510 and elastic cordage 515 which attaches to both intermediate connector 520*a* and intermediate connector 520*b*. Elastic cordage 515 may be implemented as previously disclosed with respect to other elastic cordage disclosed above. Intermediate connector 520*a* and intermediate connector 520*b* may attach on either end of a first weft of hair 525*a* and a second weft of hair 525*b*. First weft of hair 525*a* and second weft of hair 525*b* may be secured to two or more wires and may include a single layer or a double layer according to an intended implementation. As shown in FIG. 5, hair 510 may be slid away from a hair part 530 and towards intermediate connectors 520*a* and 520*b* to mimic a natural part in a user's hair. In this manner, a user may match hair addition 500 to their particular hair style, effectively maintaining the same hair style while adding volume, density, and texture to the look and feel of their hair.

Figure 6:
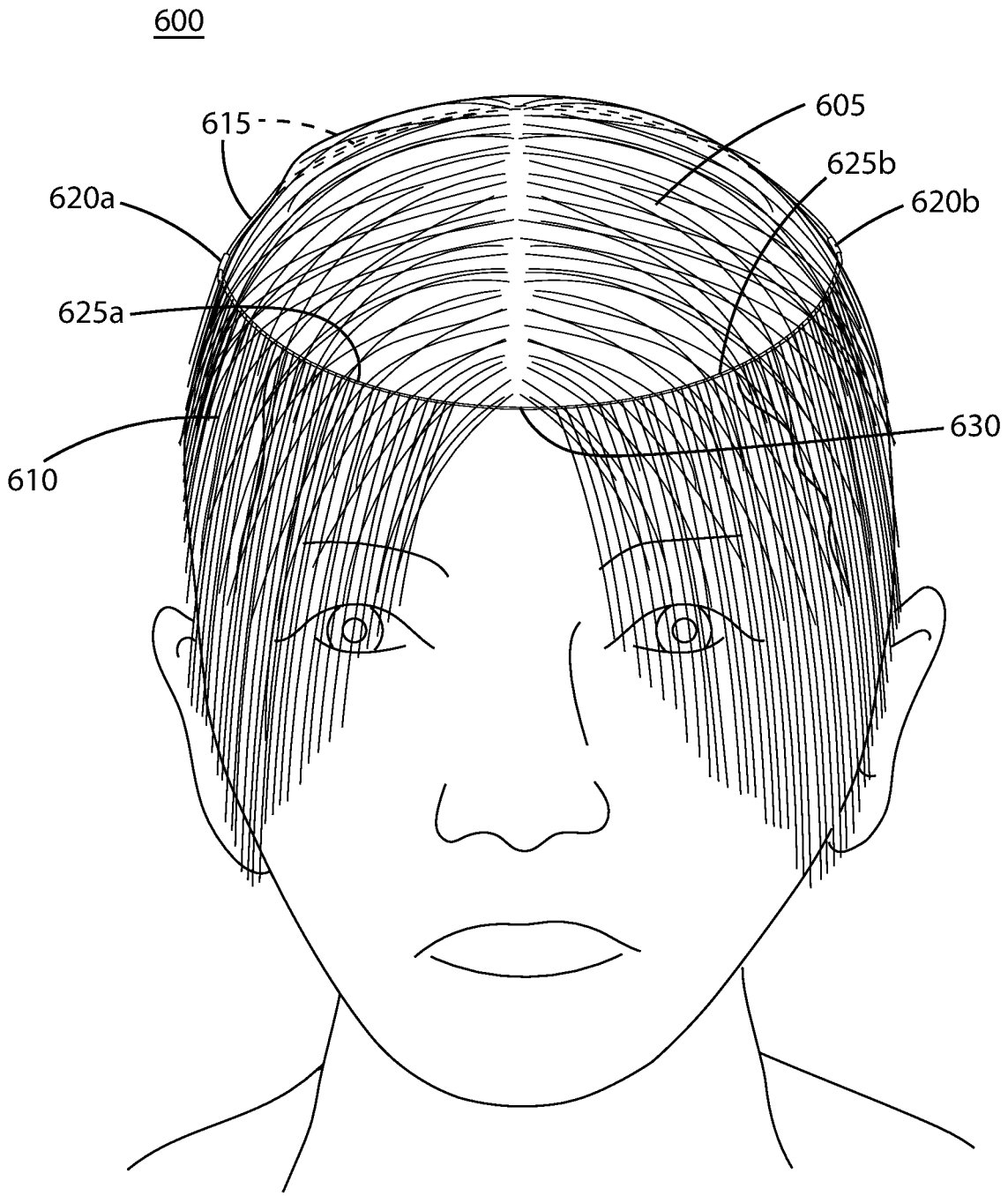
FIG. 6 illustrates a hair addition installed on a user's head.

FIG. 6 illustrates a hair addition 600 installed on a user's head 605. Hair addition 600 may be similar in implementation and description to hair addition 300 shown in FIG. 3, hair addition 400 shown in FIG. 4, and hair addition 500 shown in FIG. 5 which are described above. A user may install hair addition 600 by stretching elastic cordage 615 around the user's head 605 and pulling wefts of hair 625*a* and 625*b* into position at approximately just behind the user's hair line or bangs and over top of the user's natural hair 610. Elastic cordage 615 and intermediate connectors 625*a* and 625*b*, which are also elastic and stretchable, may securely hold hair addition 600 to the user's head by elastic tension.

As shown in FIG. 6, the user has slid weft of hair 625*a* away from weft of hair 625*b* at a single layer section of hair addition 600 to provide a hair part that aligns with the user's natural hair part. Further, hair addition 600 drastically increases the appearance of natural hair 610 the user has, especially on the side of the user's head (between the user's hair line and the user's ear) and the person's hair line or bangs along the forehead. At this point, however, hair addition 500 is visible and obvious to any observer of the user.

Figure 7:
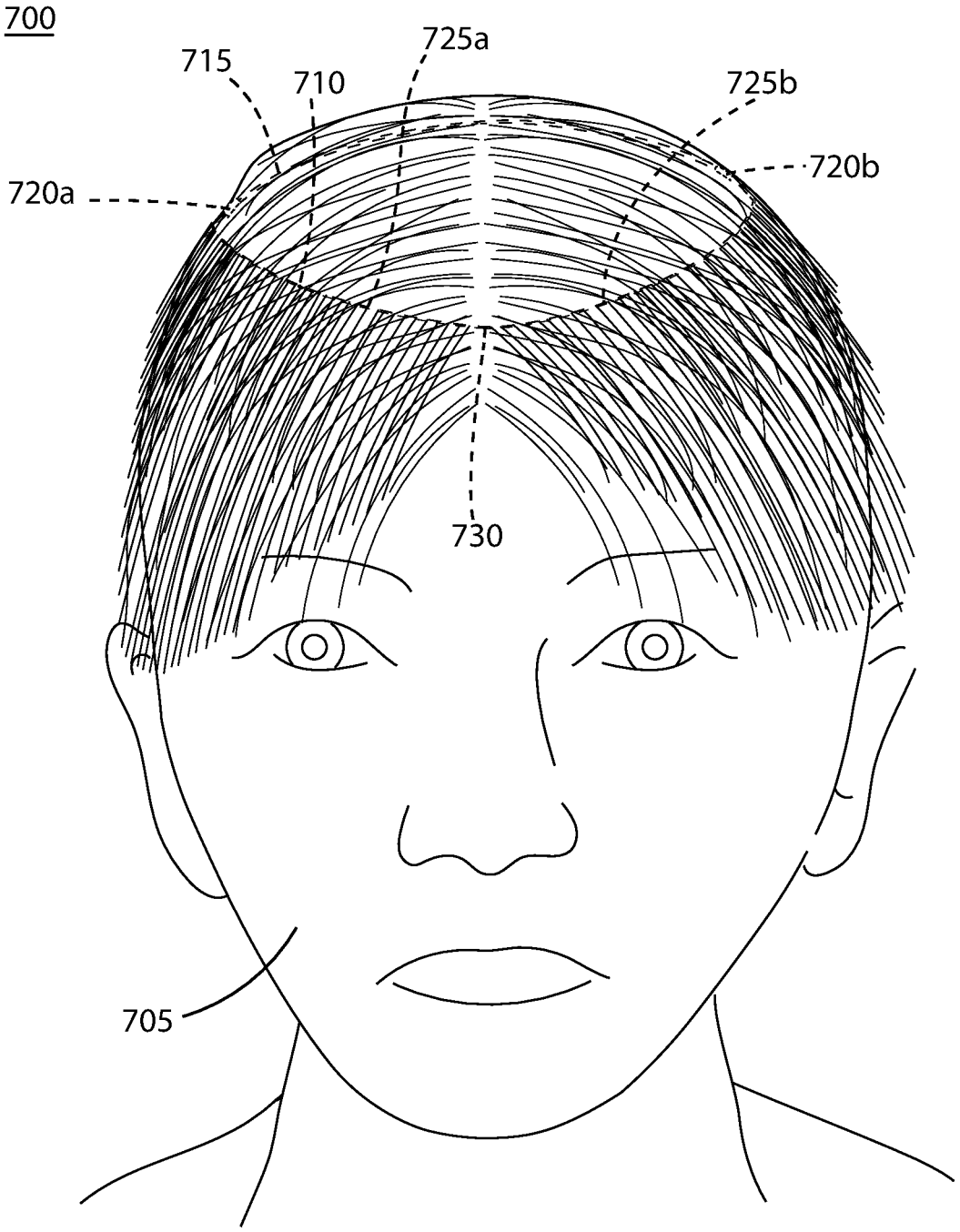
FIG. 7 illustrates a hair addition in use on a user's head.

Accordingly, FIG. 7 illustrates a hair addition 700 in use on a user's head 705 and after it has been disguised with the user's real hair 710. Hair addition 700 may be similar in implementation and description to hair addition 300 shown in FIG. 3 and hair addition 400 shown in FIG. 4 and which are described above. Transitioning from FIG. 6 to FIG. 7 illustrates that hair addition 700 may be disguised and blended into a person's natural hair. For example, elastic cordage 715 may be transparent and hidden underneath natural hair. Intermediate connectors 720*a* and 720*b* may also be hidden underneath natural hair. A user may further use a comb, a rat tail comb, a brush, a pick, or any other similar device to draw strands of natural hair 710 over wefts of hair 725*a* and 725*b* in a manner that covers wires (such as wire 101 and wire 102 shown in FIG. 1*b*ut hidden in FIG. 7) such that the wires are invisible to observers. As natural hair is drawn out from under hair addition 710, the natural hair mixes with wefts of hair 725*a* and 725*b* to create the illusion and appearance that all of the hair on the user's head is real. Further, part 730 may be aligned with the part on the user's head and be virtually invisible because of the small wire connecting the wefts of hair on hair addition 700.

Accordingly, in this manner, a user may install hair addition 700 on the user's head and increase the perceived appearance of the user's look. Since hair, throughout history, has been integral to a person's self-image, hair addition 700 may, when installed, provide the user with an enhanced sense of self and a more pleasing appearance.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A hair addition consisting of:

a first wire and a second wire, wherein the first wire and the second wire together define at least one single layer portion of hair and at least one double layer portion of hair along a length of the first wire and the second wire;

each double layer portion of hair consisting of:

first wefts of hair directly attached to only the first wire and not the second wire; and second wefts of hair directly attached to only the second wire and not the first wire;

each single layer portion of hair consisting of:

third wefts of hair directly wrapped around and knotted to both the first wire and the second wire with the first wire and second wire being in direct contact, such that the first wire and the second wire together form a single two-ply wire that is encased by the third wefts of hair;

an intermediate connector joining each of two terminal ends of the first wire and the second wire;

wherein each intermediate connector has:

one end joined to one of the terminal ends of the first wire and the second wire; and an opposite end joined to an elastic cordage; and wherein the first wire, the second wire, the intermediate connectors, and the elastic cordage together form a loop.

2. The hair addition of claim 1, wherein each of the intermediate connectors is elastic.

3. The hair addition of claim 1, wherein the first wire and the second wire in the double-layer portion of hair are spaced away from each other and are thereby separated from one another.

4. The hair addition of claim 1, wherein the elastic cordage is transparent.

5. The hair addition of claim 1, wherein the elastic cordage is the color of a scalp or a natural hair color.

6. The hair addition of claim 2, wherein the elastic cordage and the intermediate connectors are both transparent.

7. The hair addition of claim 2, wherein the elastic cordage and the intermediate connectors are both the color of a scalp or natural hair.

8. The hair addition of claim 1, wherein the third wefts are slidable along at least a portion of the length of the first wire and the second wire.

9. A hair addition consisting of:

a first wire, a second wire, and a third wire, wherein the first wire, the second wire, and the third wire together define at least one single layer portion of hair, at least one double layer portion of hair, and at least one triple layer portion of hair along a length of the first wire, the second wire, and the third wire;

each double layer portion of hair consisting of:

first wefts of hair directly wrapped around and knotted to both the first wire and the second wire and not the third wire, with the first wire and the second wire being in direct contact, such that the first wire and the second wire together form a single two-ply wire that is encased by the first wefts of hair; and second wefts of hair directly attached to only the third wire and not the first wire or the second wire;

each single layer portion of hair consisting of:

third wefts of hair directly wrapped around and knotted to the first wire, the second wire, and the third wire, with the first wire, the second wire, and the third wire being in direct contact, such that the first wire, the second wire, and the third wire together form a single three-ply wire that is encased by the third wefts of hair;

each triple layer portion of hair consisting of:

fourth wefts of hair directly attached to only the first wire and not the second wire or the third wire;

fifth wefts of hair directly attached to only the second wire and not the first wire or the third wire; and sixth wefts of hair directly attached to only the third wire and not the first wire or the second wire;

an intermediate connector joining each of two terminal ends of the first wire, the second wire, and the third wire;

wherein each intermediate connector has:

one end joined to one of the terminal ends of the first wire, the second wire and the third wire; and an opposite end joined to an elastic cordage; and wherein the first wire, the second wire, the third wire, the intermediate connectors, and the elastic cordage together form a loop.

10. The hair addition of claim 9, wherein each of the intermediate connectors is elastic.

11. The hair addition of claim 9, wherein the first wire and the second wire in the double-layer portion of hair are spaced away from each other and are thereby separated from one another.

12. The hair addition of claim 9, wherein the elastic cordage is transparent.

13. The hair addition of claim 9, wherein the elastic cordage is the color of a scalp or a natural hair color.

14. The hair addition of claim 10, wherein the elastic cordage and the intermediate connectors are both transparent.

15. The hair addition of claim 10, wherein the elastic cordage and the intermediate connectors are both the color of a scalp or natural hair.

16. The hair addition of claim 9, wherein the first wire, the second wire, and the third wire in the triple-layer portion of hair are spaced away from each other and are thereby separated from one another.

17. The hair addition of claim 11, wherein the first wire, the second wire, and the third wire in the triple-layer portion of hair are spaced away from each other and are thereby separated from one another.

18. The hair addition of claim 9, wherein the third wefts are slidable along at least a portion of the length of the first wire, the second wire, and the third wire.

* * * * *